United States Patent [19]

Fine et al.

[11] Patent Number: 4,991,324

[45] Date of Patent: Feb. 12, 1991

[54] SNOW REMOVAL DEVICE

[76] Inventor: Mark K. Fine, 150 Hillside Dr., Coopersburg, Pa. 18036; Michael L. Holben, 849 Robinhood Dr., Allentown, Pa. 18103

[21] Appl. No.: 184,420

[22] Filed: Feb. 23, 1990

[51] Int. Cl.[5] ..... E01H 5/02

[52] U.S. Cl. ..... 37/284; 37/285; 37/270; 294/54.5

[58] Field of Search ..... 37/285, 270, 265, 263, 37/278, 284; 294/54.5, 51, 59, 53.5

[56] References Cited

U.S. PATENT DOCUMENTS

| | | | |
|---|---|---|---|
| D. 200,244 | 2/1965 | Yates . | |
| 265,021 | 9/1882 | Cole | 294/54.5 |
| 281,158 | 7/1883 | Stegner | 294/54.5 X |
| 543,910 | 8/1895 | Torr . | |
| 967,270 | 8/1910 | Tiedt . | |
| 1,372,722 | 3/1921 | Paradis | 294/54.5 |
| 1,445,952 | 2/1923 | Hooper | 294/54.5 X |
| 2,598,952 | 6/1952 | Weingart | 37/270 X |
| 2,613,977 | 10/1952 | Kellogg . | |
| 2,720,043 | 10/1955 | Chamberlin | 37/285 |
| 2,728,598 | 12/1955 | Sziuage | 294/54.5 X |
| 2,891,330 | 6/1959 | Murphy . | |
| 2,958,143 | 11/1960 | Bonic . | |
| 3,035,816 | 5/1962 | Conant . | |
| 3,310,891 | 3/1967 | Sachaczenski | 37/270 X |
| 3,440,741 | 4/1969 | Yates . | |
| 4,094,543 | 6/1978 | Fratin . | |
| 4,199,181 | 4/1980 | Mason . | |
| 4,214,385 | 7/1980 | Baranowski . | |
| 4,245,411 | 1/1981 | McMath . | |
| 4,280,727 | 7/1981 | Germain . | |
| 4,302,894 | 12/1981 | Emma . | |
| 4,516,799 | 5/1985 | O'Donnell . | |
| 4,547,011 | 10/1985 | Stewart . | |
| 4,607,872 | 8/1986 | Herner . | |
| 4,669,206 | 6/1987 | Yost . | |
| 4,796,367 | 1/1989 | Kulat . | |
| 4,804,219 | 2/1989 | Berg | 37/284 X |
| 4,865,373 | 9/1989 | Hudson | 37/285 X |

*Primary Examiner*—Dennis L. Taylor
*Assistant Examiner*—J. Russell McBee
*Attorney, Agent, or Firm*—Geoff Chase

[57] ABSTRACT

A manual snow removal device is disclosed having horizontally adjustably engageable component working surfaces allowing it to clear a wide or narrow swath depending on the operator capabilities, snow depth or weight and whether a sidewalk or drive way is being cleared. Handles, which can be pivoted or extended, are affixed to the device to facilitate manual use. Trailing dolly wheels are also contemplated.

25 Claims, 3 Drawing Sheets

SNOW REMOVAL DEVICE

TECHNICAL FIELD

The present invention is directed to a manual snow removal device which eliminates the need to lift snow for removal. More particularly, the present invention is directed to the field of a snow removal device which allows for maximum force to be applied by the operator while minimizing personal bodily strain and providing means for adjusting the amount of snow removed to the individual operators capacity.

BACKGROUND OF THE PRIOR ART

In those geographical areas which receive any appreciable amount of snow in the winter season, individuals who must perform personal snow clearing operations, such as on sidewalks and private driveways, have typically relied upon snow shovels for manual removal of snow. Such snow shovels have been designed with various styles and materials to attempt to overcome the single greatest detriment of snow removal by shoveling, which is the undue force necessary to lift and remove snow by shovel which force must be communicated through the lower torso of the individual performing the snow clearing operation with the resulting inefficiency of snow removal and the risk of physical injury particularly to the lower torso, or more seriously, the risk of exceeding the cardiovascular condition of the operator.

The prior art has attempted to overcome the deficiency of shovels in snow removal operations performed manually.

As early as 1895, a snow shovel was disclosed in U.S. Pat. No 543,910 which had two handles and a surface which is held at a 45 degree angle to the ground for the accumulation of snow for removal.

A more vertically rectangular snow removal board is illustrated in Design Pat. No. 200,244, as well as the related Utility Pat. No. 3,440,741, wherein a rectangular board is fitted with two angled handles for manual operation and a plate is provided at the ground bearing edge of the board to assist in elevation of the board off the ground when containing snow.

U.S. Pat. No. 4,245,411 discloses a manual scoop type snow pusher/lifter which recites some of the advantages of pushing snow during a removal operation rather than lifting snow.

U.S. Pat. No. 4,516,799 discloses a snow removal implement having a polygonal body with two hand inserts which provides a method for snow removal apparently requiring a tricky move employing two hands and a free foot to fling snow to the side of the cleared area while balancing on a remaining foot.

U.S. Pat. No. 4,607,872 discloses a snow removal device comprising a board of hard but resilient material having hand holds on its uppermost side that are used in conjunction with hand holds on its lateral sides.

U.S. Pat. No. 4,796,367 discloses a manual snow plow which is pulled rather than pushed and has an adjustably displaced V-shaped surface for pushing snow to the side of the line of attack in the snow removal operation.

Additional prior art of general interest include: U.S. Pat No. 967,270; U.S. Pat. No. 2,613,977; U.S. Pat. No. 3,035,816; U.S. Pat. No. 2,891,330; U.S. Pat. No. 4,199,181; U.S. Pat. No. 4,302,894; U.S. Pat. No. 4,547,011; and U.S. Pat. No. 4,669,206.

Despite the fact that the prior art has improved upon the common snow shovel for snow removal operations conducted manually by an individual, the prior art has failed to provide a successful snow removal device which can be adjusted to the job to be performed or the individual capabilities of the manual operator of the snow removal device. Additionally, the prior art has not made provisions for meaningful amounts of assistance of a mechanical nature in snow removal or ease in passing a snow removal device over a surface to be cleared. The present invention, set forth below in greater detail, overcomes these disadvantages of the prior art as will be more adequately set forth below.

BRIEF SUMMARY OF THE INVENTION

The present invention is a snow removal device for manual use in plowing snow from a snow covered ground surface, comprising: a generally flat, planner composite working surface of at least two flat, planner component working surfaces, each having a ground engaging edge, an outside edge, an inside edge and a top edge, which component working surfaces are horizontally adjustably engaged one with the other to provide a range of extension of the width of the composite working surface, whereby the component working surfaces' respective inside edges overlap one another, the component working surfaces are temporarily fixed one to the other by fastening means which engages the component working surfaces to disengageably lock the component working surfaces into one of a plurality of the widths, and the composite working surface having one or more handles extending beyond the top edge of the composite working surface to facilitate manual operation by an individual during snow removal.

Most perferably, the fastening means comprises two locking pins which pass through an overlapped portion of the composite working surfaces.

Preferably, each component surface has a series of apertures to engage the locking pins, which apertures of each component working surface can be matched with a corresponding aperture on the other working surface to define a temporarily fixed width of the overall composite working surface.

Preferably, the fastening means comprises closely sized ground engaging and top edges of each component working surface which allow one working surface to frictionally slide within the annular structure of the other working surface telescopically.

Alternatively the fastening means is a series of vertically arranged interlocking grooves on each of the component surfaces.

Preferably, the fastening means comprises rigidly affixed parallel plates forming a channel into which the top edges of the composite working surface slideably fit and at least one locking pin which passes through the plates and the composite working surfaces. Optimally, the base of the channel of the fastening means engages the top edges of the composite working surfaces and in cooperation with a single locking pin disengageably fixes the component working surfaces in a position of the horizontally adjustable engagement of the component working surfaces.

Preferably, two handles are affixed to the composite working surface. Optimally, a handle is mounted on each of the two component working surfaces. Further, the handles are preferably mounted on the back surface of the composite working surface.

Preferably, the handles are pivotally mounted on the composite working surface to be adjusted in one of the plurality of disengageably fixed widths in cooperation with the position of the horizontally adjustable component working surfaces one with the other.

Alternatively, the handles are mounted to the composite working surfaces with a single pin around which the handles pivots and an U-bolt which disengageably positions the handle on the working surface in a fixed position.

Preferably, in one embodiment the composite working surface is wood. Alternatively, the composite working surface is metal. Alternatively, the composite working surface is fiberglass. Further alternatively, the composite working surface is plastic.

Preferably, the handles are extendable along their longitudinal axis.

Preferably, the fastening means is metal. Alternatively, the fastening means is plastic.

Preferably, the composite working surface is substantially rectangular in shape in the plane of the working surface.

Alternatively, one or more ground engaging wheels are affixed to the back surface of the composite working surface. Optimally, a wheel is affixed to each of the two component working surfaces. Preferably, the wheels are mounted on a bracket which in turn is affixed to the back surface of the composite working surface proximate the ground engaging edge. Optimally, the wheels are positioned to allow the composite working surface to rest at an acute angle to the ground and the back surface.

Preferably, the composite working surface has a plurality of formed cylindrical channels perpendicular to the top edges of said surface and parallel to the plane of the working surface to frictionally and disengageably hold said handle.

Preferably, each composite working surface has a substantially flattened tubular cross-sectionally shape.

DETAILED DESCRIPTION OF THE INVENTION

Figure 2:
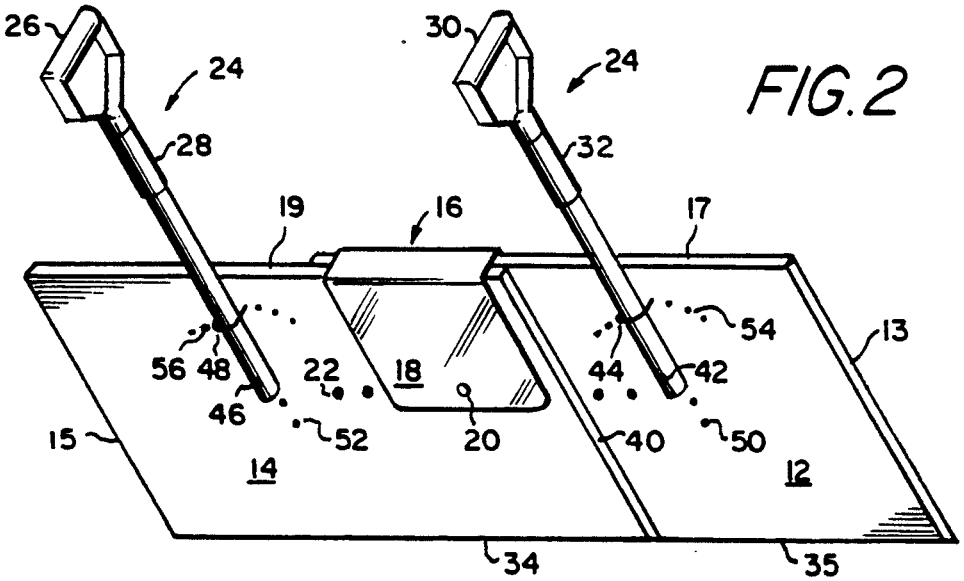
FIG. 2 is a back view of a first embodiment of the present invention.

The present invention is a manually operated snow removal device which provides a composite working surface or flat blade element to push and lift snow off of a ground surface, such as a sidewalk or driveway, while employing the strength of the lower portion of the body, including hips and legs as the motive force, while avoiding the necessity of lifting and tossing snow with the upper body, which would cause undue exertion and potential body strain or injury. The present invention utilizes preferably two extended handles from the composite working surface, which allow the operator to push the working surface with the operators arms without bodily lifting of snow to effect removal. The handles affixed to the working surface of the snow removal device of the present invention engage the working surface and are positioned so as to provide ease of human operation without stooping or placing the operators body at a disadvantageous position for the application of force or the potential for bodily strain or injury particularly to the lower back region of the operator.

More importantly, the snow removal device of the present invention comprises a composite working surface made up of several horizontally adjustably engageable component working surfaces which extend the width of the composite working surface over a variable range of width extension or retraction so as to tailor the work load of the snow removal device to the particular operators physical capability, the job to be performed, such as driveway verses sidewalk clearing, and the conditions of the snow to be removed, particularly depth and water content.

Unlike snow shovels and snow removal devices of the prior art, the present invention allows the operator to adjust the width of the device so that the composite working surface acting against the snow to be removed can be of a width matching, for instance, a sidewalk width or an appropriate portion of a driveway to make the operation of snow removal more efficient. The adjustment of width by adjusting the horizontally adjustably engaged component working surfaces making up the composite working surface allows the individual operator to adjust the amount of snow removal work, and therefore the force necessary to effect snow removal, to the particular personal needs of the operator. For instance, the obvious difference in male and female physical capabilities in exerting force can be taken into account with the snow removal device of the present invention. Differences in size and physical condition of operators can also be taken into account by the adjustability of the present invention. Even within the context of a single operator's physical stature and capabilities the snow removal device of the present invention can be adjusted to utilize this singular level of force of the operator to match the variable conditions of snow to be removed. For instance, snow cover is obviously of varying depths depending upon the meteorological conditions existing at time of snow fall. Varying depths of snow are encountered during any period of potential snow clearing. The present invention, unlike prior art snow shovels and removal devices can be adjusted even by a single operator to allow the operator to match the amount of the snow or depth of the snow to be removed after any given snow fall. Exemplary of such adjustment would be the retraction of the width of the composite working surface for snows of significant depth to be removed, while the composite working surface width can be extended for snow removal of snows of minimal depth.

The present invention also excels over prior art snow removal devices and snow shovels in providing flexibility of size to match the physical parameter of the snow to be cleared other than depth. As most individuals are aware in those geographical areas where snow is a recurrent problem, irrespective of snow depth, snow can have differing physical properties. Relatively dry fluffy snow is found to be light in weight and have a relatively low equivalent water content for given volume in comparison to what is generally referred to as wet packed snows which have a relatively high equivalent water content per volume. This phenomena is well recognized by people engaged in the operation of snow removal, particularly those utilizing manual implements, such as snow shovels for snow removal. The amount of work exerted to remove equivalent volumes of wet snow is considerably in excess of the work necessary to remove equivalent volumes of light dry snow. Only the unique feature of the present invention with its horizontally adjustably engageable component working surfaces which provide for a range of extension of the composite working surface allows the individual operator to make the necessary adjustments to such physical conditions of the snow, so as to operate the device for snow removal in the most efficient manner with the least fatigue and least potential for injury to the operator of the device.

In addition to the advantages of the horizontally adjustably engageable component working surfaces, the present invention enjoys the mechanical advantage of having adjustably extendable and extended handles from the composite working surface, which allow the operator to apply the mechanical advantage of leverage to the working surface during snow removal while minimizing the overall dimension of the composite working surface, and thus its weight, which is a necessary factor in the ease of operation of the device. The present invention in utilizing handles extended from the working surface which can be affixed in a plurality of alignments and lengths further enhances the ease of operation of the device for snow removal while providing further degrees of freedom for the matching or tailoring of the device to the operators physical stature and physical capabilities.

Additionally in an alternate embodiment provision, the present invention provides for a wheeled fulcrum component which further enhances the mechanical advantage of the present invention for snow removal, while at the same time providing an appropriate means for transporting the device over cleared surfaces to the point where snow removal will be performed. The wheeled fulcrum device of the alternative embodiment to the present invention provides further mechanical assistance in the operation of the snow removal device of the present invention by at least in part converting sliding frictional engagement of the working surface with the ground surface to be cleared to rolling frictional engagement which is well established to provide diminished frictional retarding force acting against the operator.

Figure 1:
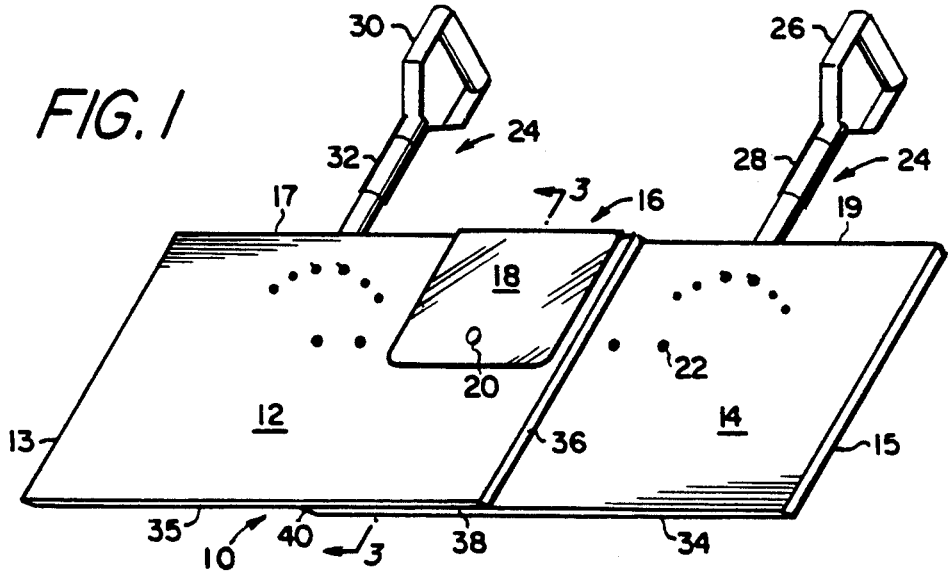
FIG 1 is a front view of a first embodiment of the present invention.

The present invention will now be described with respect to a first embodiment with reference to FIG. 1. In FIG. 1 a snow removal device for manual use in plowing snow from a snow covered surface is illustrated comprising a generally flat, planner composite working surface 10 made up of at least two component flat, planner working surfaces 12 and 14, each having a ground engaging edge 35 and 34, respectively, an outside edge 13 and 15, respectively, an inside edge 36 and 40, respectively, and a top edge 17 and 19, respectively. As can be seen from the drawing, the component working surfaces 12 and 14 are horizontally adjustably engaged one with the other to provide a range of extension of the width of the composite surface 10 whereby the component working surfaces' 12 and 14 respective inside edges 36 and 40 have a portion of overlap 38. The composite working surface generally is 20 inches high and provides approximately 6 square feet of surface area.

The component working surfaces 12 and 14 are temporarily fixed one to the other by a fastening means 16 which in this embodiment comprises rigidly affixed parallel plates 18 forming a channel into which the top edges 17 and 19 of the composite working surfaces 12 and 14 slideable fit. A locking pin 20, such as a bolt and nut, passes through plate 18 and the composite working surface 10 to engage the component working surfaces to disengageably lock the component working surfaces into one of a plurality of set widths one to the other. The locking pins could also be selected from rods, nails, screws, cotter keys, pegs, and other well known fastening means. Preferably, the fastening device 18 has a U-shaped cross-section, in which the base of the U-shape forms a channel which is juxtaposed to the top edges 17 and 19 of the component working surface 12 and 14 to provide a rigid engagement in cooperation with the locking pin or pins. Although one pin 20 is shown in FIG. 1 with a multitude of selectable apertures 22, it understood that several pins could be utilized.

Where at least several pins are utilized, the fastening means could be deemed to be the pins themselves without the necessity of a device comprising parallel plates forming a channel with a U-shaped cross-section. This is a more preferred embodiment, especially for devices fabricated from wood or fiberglass.

The snow removal device of FIG. 1 includes two pivotally adjustable handles 24 comprising telescopically extendable arms 28 and 32, respectively. The handles terminate in looped hand engaging ends 26 and 30 respectively. The handles 24 can have their arms 28 and 32 telescopically extended in traditionally known manner, such as two frictionally engaged annular pipes of close cross-sectional dimension which are adjusted by a force applied longitudinally, or any one of a series of locking means, such as wing nuts or pin engagement, can be contemplated. The height of the device from the ground-engaging edges to the top of the ends 26 and 30 is approximately 48 inches.

With reference to FIG. 2, the back side of the first embodiment of the snow removal device of the present invention can be seen, whereby the connection of the handles 24 to the component working surfaces 12 and 14 are viewed. In this first embodiment, the arms 28 and 32 respectively of the handles are pivotly fixed by pins 46 and 42 to the component working surfaces 14 and 12, respectively, and are temporarily fixed in a particular alignment extending from the top edges 19 and 17 respectively of the composite working surface 10 by U-bolts, which pass into and potentially through the component working surfaces by means of apertures 56 and 54, respectively. This allows the handles to be adjusted to the stature of different physical dimensions of operators, as well as the different degrees of extension of the component working surfaces of the snow removal device. In addition to the telescoping of the handles 24, it is also possible to adjust the physical location of the handles on the component surfaces by location of the pins 42 and 46 in one of a series of apertures which engage or pass through the component surfaces, such apertures illustrated as 50 and 52, respectively, in the component working surfaces 12 and 14.

Figure 3:
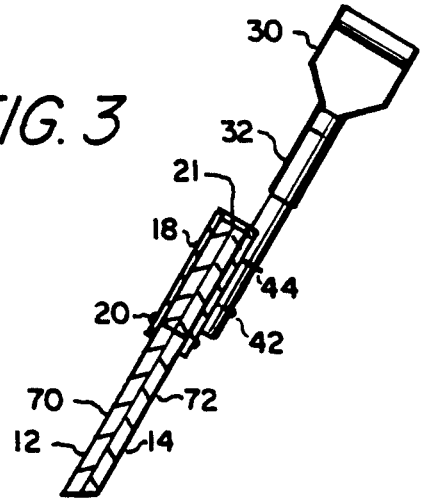
FIG. 3 is a side view of a first embodiment of the present invention.

With reference to FIG. 3, the structure of the first embodiment of the present invention will be seen with greater clarity. FIG. 3 is a cross sectional view of the snow removal device of the present invention taken along the sectional line 3 of FIG. 1. This view shows the front surface 70 of the component working surface 12 and the rear or trailing surface 72 of the component working surface 14. The channel 21 formed by the U-shaped portion of the parallel plates 18, is also illustrated, wherein the fastening device engages the top surfaces of the component surfaces to provide for cooperative engagement with pin 20 to affix temporarily the relative position of the horizontally adjustably engageable working surfaces.

Figure 4:
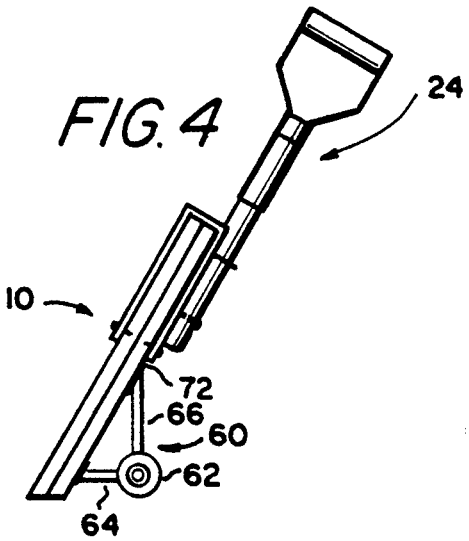
FIG. 4 is a side view of an alternative embodiment to the present invention.

FIG. 4 illustrates the snow removal device of the present invention in an alternate embodiment, wherein mounted on the trailing edge 72 of the snow removal device 10 is a wheeled bracket 60 comprising a horizontal bracket 64 and a vertical bracket 66 which support a wheel 62. One or more of such wheeled brackets are contemplated in the preferred embodiment of this alternate embodiment. It would be deemed that each component working surface would have a bracket wheeled support to provide two bracketed wheeled supports for the composite working surface. This wheeled bracket allows ease of transport of the snow removal device along non-snow removal areas, for instance transport from storage through a garage out to an area of snow cover, while additionally providing reduced frictional drag when the snow removal device is utilized in clearing snow from areas, such as sidewalks and driveways. It can be appreciated that the more coarse and frictionally dragging the surface to be cleared the more advantageous the utilization of such depending wheels from the back surface of the composite working of the snow removal device of the present invention. Further, it can be appreciated that as snow piles up on the snow removal device of the present invention as it is utilized in its preferred forty-five degree angled posture from the surface being cleared, the wheeled brackets can be used to advantage to provide mechanical advantage of lever action in dispensing with the snow from the path being cleared. It can also be contemplated that those of diminished physical stature or capacity such as women, juveniles, or elderly and handicapped individuals would have advantage with the wheeled bracket configuration of the present invention.

Figure 5:
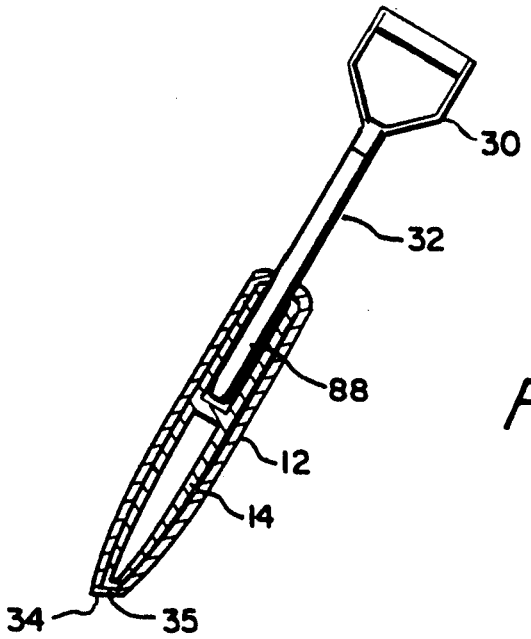
FIG. 5 is a side view of a second embodiment of the present invention.

With reference to FIG. 5, a second embodiment of the present invention is illustrated in a cross-sectional view. This embodiment is best illustrated or contemplated as two plastic substantially-flattened, tubular, cross-sectional shaped component working surfaces 12 and 14 which have closely-sized ground engaging edges and top edges, such as ground engaging edges 34 and 35 which provide the frictional fit necessary to temporarily affix the horizontally adjustably engageable width of the composite working surface. Although this embodiment is contemplated as a hollow, rigid plastic configuration, it is also possible to make one or more of the embodiments of the present invention from wood, metal, plastic, fiberglass, graphite, particle board, or other materials with sufficient rigidity and strength for the configurations illustrated in the snow removal device contemplated. With reference to the second embodiment illustrated in FIG. 5, the arm 32 of the handles would be fitted through apertures in the top edge of the component working surfaces in special cylindrical channels 88 formed in the smaller or inside flattened tubular component working surface which match with the opening in the top edge of the larger flattened tubular plastic component working surface 12.

Figure 6:
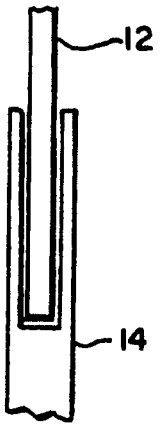
FIG. 6 is a partial top view of an alternate embodiment of the present invention.

FIG. 6 illustrates a partial top view of an alternative engagement means for the component working surfaces 12 and 14 of the present invention wherein component working surface 12 fits within an appropriate slot in component working surface 14.

Figure 7:
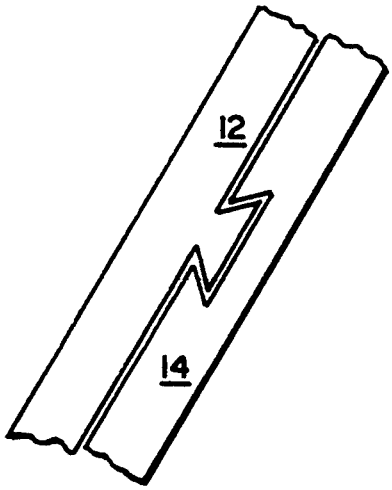
FIG. 7 is a partial side view of an alternate embodiment of the present invention.
Figure 8:
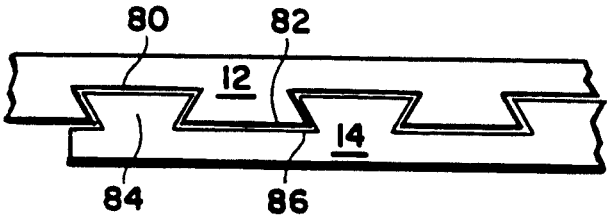
FIG. 8 is a partial top view of an alternate embodiment of the present invention.

FIG. 7 illustrates yet another embodiment of the engagement of the component working surfaces 12 and 14 wherein corresponding interlocking grooves and ridges commonly referred to from their cross-sectional shape as dove-tails engage one with the other. Although only one set of grooves and ridges is shown it is understood that a series of such grooves and ridges could be used in either the horizontal plane as shown or in the vertical orientation so as to define a series of widths to the composite working surface by the selection of how many such interlocking grooves and ridges of each component working surface would be engaged one with the other. FIG. 8 shows a top view of a partial illustration of a composite working surface preferably constructed of plastic, wherein component working surfaces 12 and 14 have integral dove-tail grooves 80 and 86, respectively, that engage dove-tail ridges 82 and 84, respectively, to act as fastening means. The grooves and ridges are oriented in a vertical alignment.

The presented invention has been illustrated with reference to several embodiments, components, and materials of construction which should not be deemed to be limitations on the unique enhancement of the snow removal device provided with horizontally adjustably engageable component working surfaces which allow for adjustment of width of the working surface to match physical capabilities of operators and physical conditions of snow to be removed which attribute and the various features illustrated and described above provide an unexpected enhancement and advantage of the present invention over the snow removal devices and snow shovels of the prior art.

These embodiments and illustrations should not diminish the scope of the invention which should be ascertained from the claims which follow.

I claim:

1. A snow removal device for manual use in plowing snow from a snow covered ground surface comprising a generally flat, planar composite working surface of at least two flat, planar component working surfaces, each having a ground engaging edge, an outside edge, an inside edge and a top edge, which component working surfaces are horizontally adjustably engaged one with the other to provide a range of extension of the width of the composite working surface, whereby said component working surfaces' respective inside edges overlap one another, said component working surfaces are temporarily fixed one to the other by fastening means which engages the component working surfaces to disengageably lock said component working surfaces into one of a plurality of said widths, and said composite working surface having one or more handles extending beyond said top edge of said composite working surface to facilitate manual operation by an individual during snow removal, wherein a handle is mounted on each of the two component working surfaces.

2. The device of claim 1 wherein the fastening means comprises two locking pins which pass through an overlapped portion of the component working surfaces.

3. The device of claim 2 wherein each component working surface has a series of apertures to engage said locking pins, which apertures of each said component working surface can be matched with a corresponding aperture on the other said component working surface to define a temporarily fixed width of the overall composite working surface.

4. The device of claim 1 wherein the fastening means comprises closely sized ground engaging and top edges of each component working surface which allow one working surface to frictionally slide within an annular structure of the other working surface telescopically.

5. The device of claim 1 wherein the fastening means comprises a series of vertically arranged interlocking grooves on each of the component working surfaces which engage corresponding ridges on the other of said surfaces.

6. The device of claim 1 wherein the fastening means comprises rigidly affixed parallel plates forming a channel into which the top edges of the composite working surface slideably fit and at least one locking pin which passes through said plates and said composite working surface.

7. The device of claim 6 in which the base of the channel of the fastening means engages the top edges of the composite working surface and, in cooperation with a single locking pin, disengageably fixes the component working surfaces in a position of the horizontally adjustable engagement of the component working surfaces.

8. The device of claim 1 wherein two handles are affixed to the composite working surface.

9. The device of claim 8 wherein the handles are mounted on the back surface of the composite working surface.

10. The device of claim 9 wherein the handles are pivotally mounted on the composite working surface to be adjusted on one of a plurality of disengageably fixed positions in cooperation with the position of the horizontally adjustable component working surfaces one with the other.

11. The device of claim 10 wherein the handles are mounted to the composite working surface with a single pin around which the handle pivots and a U-bolt which disengageably positions the handle on the component working surface in a fixed position.

12. The device of claim 1 wherein the composite working surface is wood.

13. The device of claim 1 wherein the composite working surface is metal.

14. The device of claim 1 wherein the composite working surface is plastic.

15. The device of claim 1 wherein the composite working surface is fiberglass.

16. The device of claim 1 wherein the handles are extendable along their longitudinal axis.

17. The device of claim 1 wherein the fastening means is metal.

18. The device of claim 1 wherein the fastening means is plastic.

19. The device of claim 1 wherein the composite working surface is substantially rectangular in shape in the plane of the working surface.

20. The device of claim 1 wherein one or more ground engaging wheels are affixed to the back surface of the composite working surface.

21. The device of claim 20 wherein a wheel is affixed to each of the two component working surfaces.

22. The device of claim 21 wherein the wheels are mounted on a bracket which in turn is affixed to the back surface of the composite working surface proximate the ground engaging edge.

23. The device of claim 22 wherein the wheels are positioned to allow the composite working surface to rest at an acute angle to the ground and the back surface.

24. The device of claim 1 wherein the composite working surface has a plurality of formed cylindrical channels perpendicular to the top edges of said surface and parallel to the plane of the working surface to frictionally and disengageably hold said handle.

25. The device of claim 1 wherein each composite working surface has a substantially flattened tubular cross-sectional shape.

* * * * *